United States Patent [19]

Aaltonen et al.

[11] 4,030,915

[45] June 21, 1977

[54] PROCESS FOR PRODUCING RAW COPPER CONTINUOUSLY IN ONE STAGE FROM UNREFINED SULFIDIC COPPER CONCENTRATE OR ORE

[75] Inventors: Olavi August Aaltonen, Pori; Bengt Torsten Andersson, Espoo; Jyrki Tapani Juusela, Pori; Matti Johannes Palperi, Imatra; Tapio Kalevi Tuominen, Pori, all of Finland

[73] Assignee: Outokumpu Oy, Helsinki, Finland

[22] Filed: Aug. 21, 1975

[21] Appl. No.: 606,532

[30] Foreign Application Priority Data

Nov. 11, 1974 Finland ..... 743266

[52] U.S. Cl. ..... 75/74; 75/76

[51] Int. Cl.[2] ..... C22B 15/00

[58] Field of Search ..... 75/72, 73, 74, 76, 23; 266/11

[56] References Cited

UNITED STATES PATENTS

| | | | |
|---|---|---|---|
| 3,460,817 | 8/1969 | Brittingham | 266/11 |
| 3,790,366 | 2/1974 | Bryk et al. | 75/23 |
| 3,796,568 | 3/1974 | Szekely et al. | 75/74 |
| 3,900,310 | 8/1975 | Kaasica et al. | 75/23 |
| 3,948,639 | 4/1976 | Nermes et al. | 75/74 |

*Primary Examiner*—Walter R. Satterfield
*Attorney, Agent, or Firm*—Brooks, Haidt, Haffner & Delahunty

[57] ABSTRACT

Process for producing raw copper continuously in one stage from sulfidic copper concentrates and ores containing impurities such as lead, antimony, bismuth and arsenic, by feeding finely-divided copper concentrate and ore and oxygen or oxygen-enriched air into the upper part of the reaction zone to produce a suspension in the reaction zone, the suspension being fed, at a high temperature, downwards in the reaction zone in order to cause the suspension to impinge against the melt below the reaction zone, while the gases and flying dusts are directed aside, the flying dusts being possibly recycled into the upper part of the reaction zone, and slag and raw copper, which is recovered, are separated from the melt, wherein so much oxygen or oxygen-enriched air is fed into the reaction shaft in proportion to the copper concentrate and ore that the concentrate and ore is oxidized in the reaction zone to such a degree that a melt containing only raw copper and slag is produced below the reaction zone.

1 Claim, 7 Drawing Figures

$Cu_{Slag}$ = 5-8 %
$S_{Met}$ = 0,1-1,5 %
$O_{Met}$ = 0,3 %
$Fe_{Matte}$ = 0-3 %

$Cu_{Slag}$ = 8 - 15 %

$S_{Met}$ < 0,5 %

$O_{Met}$ = 0,3 - 1,5 %

PROCESS FOR PRODUCING RAW COPPER CONTINUOUSLY IN ONE STAGE FROM UNREFINED SULFIDIC COPPER CONCENTRATE OR ORE

BACKGROUND OF THE INVENTION

The present invention relates to a process for producing raw copper continuously in one stage by suspension smelting from sulfidic copper concentrates or ores containing impurities such as lead, antimony, bismuth and arsenic.

Most of the world's copper is still produced today by conventional processes which involve several different intermediate stages and products. The smelting of concentrate, or partly roasted concentrate, and slag-forming materials is performed in a basic smelting unit (reverberatory, electric, shaft or flash smelting furnace), whereafter the produced sulfidic copper matte is transferred to the converter for the production of blister copper. The last stage is normally a hot refining in order to regulate the oxygen and sulfur contents. The oxidic slag produced in the basic smelting unit is either rejected or treated further, depending on its valuable metal content. The converter slag is refined either separately or by returning it to the basic smelting unit. When treating unrefined concentrates by conventional processes it is clear, owing to the several intermediate products and the possibilities of varying each partial process independently, that impurities can easily be prevented from coming into the anode copper. This is so because in each partial process the sulfur and oxygen potentials of the system are different, and there by harmful secondary components can be removed selectively. On the other hand, if the batch process is used for the conversion, the values of the system change when the reactions proceed and this aids the formation of various intermediate products which can be removed when necessary.

The situation changes entirely when continuous processes are adopted, in which the produced metal is in an equilibrium with the various mattes and slags of the process or tends to reach such an equilibrium.

When discussing impurities present in copper concentrates, almost all elements except copper can be included among the impurities generally speaking. The number of components is actually smaller, since there are some which cannot thermodynamically dissolve to a harmful degree in the produced copper under the conditions prevailing in direct processes. Some of these are usually the strongly slag-forming components (e.g., Fe, Co, Zn, Cr, Ti, Ca, Si), which transfer to the silicate phase. On the other hand, it is desirable that some components accumulate in the raw copper (noble metals), and the removal of some (e.g. Ni) is relatively simple in the electrolytic process. Thus, some of the impurities usually counted as actually harmful are Pb, Sb, As, Bi.

When reviewing the patents relating to suspension smelting, it can be noted that the production of metal directly in the flash smelting furnace has long been under discussion. The process according to Finnish Pat. No. 22 694 constitutes an autogenic, basic suspension smelting process. Further, Finnish Pat. Nos. 45 866 and 47 380 describe how oxygen and sulfur pressures are used in controlled reaction shafts to create favorable conditions for the formation of white metal or even raw copper in the lower furnace. These patents deal with pure copper concentrates and only suggest the possibility of producing raw copper in a flash furnace without presenting more detailed examples.

When discussing other direct and/or continuous copper processes, they can be divided into two categories in regard to the oxidation of sulfides: (a) conversion-type processes in which most of the oxidation is performed in molten bath with the aid of either tuyeres or lancets and (b) suspension-type processes in which the oxidation reactions primarily occur in a suspension consisting of a finely-divided concentrate and reaction gas (combustion air).

The first example to be mentioned among the conversion-type processes is the Noranda process (Finnish Pat. No. 45 566 ), in which raw copper is produced from concentrates by a continuous process in one unit. The concentrates and slag-forming materials are added onto the molten bath and the oxidation takes place with the help of tuyeres under the melt surface. During continuous operation the melt comprises three layers which are only slingtly soluble in each other: slag, matte and raw copper. The slag (for further refining) and the sulfur-bearing raw copper are removed from the reactor. The smelting of unrefined concentrates is not discussed in the patent cited above, but according to an article concerning the same process (N.J. Themelis, G.C. McKerrow, P. Tarassoff, and G.D. Hollet: "The Noranda Process for Continuous Smelting and Converting of Copper Concentrates", 100th AIME Annual Meeting, New York, March 1–4, 1971), the removal of over 80% of the lead takes place by evaporation from the slag surface. The value is based on the lead contents of the slag and of the raw copper, given in the article, in which case in the concentrate Pb~1.2%.

The Worcra process can be mentioned as a second "conversion-type" process. It is described in, for example, U.S. Pat. No. 3 326 671 and in an article by H.K. Worner, J.O. Reynolds, B.S. Andrews and A.W.G. Collier: "Developments in WORCRA smelting-converting", Proceedings of an International Symposium, organized by the Institute of Mining and Metallurgy, London, Oct. 4–6, 1971. In this process the smelting of the concentrate and the slagging material takes place on the surface of the melt and the main oxidation by means of lancets from under the surface. The process operates according to the countercurrent principle to the effect that the waste slag and the raw copper are removed from opposite ends of the furnace. There are again very few references to unrefined concentrates. It is only noted in the article that an evaporation of 89% of the lead is possible (the lead content of the concentrate is 2.2%).

The Mitsubishi process can be mentioned as a third "conversion process". This process is described in, for example, Finnish Pat. Application 1397/73 and an article by T. Suzuki and T. Nagano: "Development of New Continuous Copper Smelting Process", Joint Meeting MMIJ - AIME, May 24–27, 1972, Tokyo. The system comprises three separate furnace units (smelting, slag-purification, and conversion) with a continuous flow of material between them. The actual burning of sulfur is performed with surface blast lancets, whereby raw copper is produced in the converter unit. In this process, as in the other conversion processes, there are three layers in the melt: slag, matte and raw copper. This is clearly indicated by the sulfur content of the raw copper produced (0.5 – 1.0% S), since it dissolves sulfur in an amount approaching equilibrium when it is produced by oxidation from molten sulfidic matte. As to impurities, it is mentioned in connection with the Mitsubishi process that when the copper content (~degree of oxidation) of the slag in the actual conversion furnace is raised, a Pb content within the range 0.2 – 0.5% is obtained for the produced raw copper, the lead content of the concentrate being 1.9 – 2.3%. Likewise, by raising the degree of oxidation it is possible to reduce the rates of other volatile impurities (As and Sb) in the raw copper as well. By this procedure the impurities can be removed in the dusts from the furnace.

When discussing the "suspension-type" processes for producing copper directly from concentrates, a few more processes can be mentioned in addition to those mentioned previously. Firstly, the Brittingham process (Finnish Pat. No. 45 463), in which an oxidation to the white-metal degree is performed in the reaction shaft, and the white metal is then further oxidized into raw copper. The purification of slag can be performed in the same unit in another part of the lower furnace. As in the conversion process, there are three melt phases: slag, matte and raw copper. No information has been given about the behavior of the impurities. Another possibility worth mentioning is the process introduced by J.C. Yannopoulos (U.S. Pat. No. 3, 674, 463), in which the copper matte produced during the first stage is further cycled in a molten state to be oxidized either in the same or a separate reaction shaft. By this procedure it is possible, according to the patent, to create metallic copper and a slag poor in valuable metals by maintaining a white-metal layer between the metal and slag phases. Neither in this patent is there mention of the behavior of the impurities.

The object of the present invention is thus to provide a process for the production of raw copper directly in the flash smelting furnace from impure sulfidic copper concentrate and/or ore by burning it with oxygen or oxygen enriched air.

SUMMARY OF THE INVENTION

According to the invention there is now provided a process useful for continuously producing raw copper which is substantially devoid of impurities, and directly in one stage so that the impurities of the concentrate or ore are transferred to the slag phase of the melt. The process according to the invention is carried out by oxidizing the concentrate or ore in suspension to such a degree that the melt contains only a slag phase and a metal phase.

When discussing the process according to the invention for smelting impure copper concentrates directly into raw copper in a flash smelting furnace, lead can be regarded as the main impurity since, firstly, it is a very common harmful secondary component in copper concentrates and, secondly, its distribution between the various products of the process illustrates the degrees of oxidation prevailing in the system and at the same time the behavior of other impurities. The process according to the invention can thus be used for eliminating even other impurities than Pb from raw copper, if this is possible thermodynamically with similar changes in the degree of oxidation. Such impurities are, for example, Sb, As, and Bi. The new process is especially well applicable to cases in which the produced slag quantity and its valuable metal content are substantially smaller than when using concentrates which besides chalcopyrite also contain great quantities of other iron compounds (e.g. sulfides and oxides). Some such advantageous copper concentrates are chalcocite-digenite-based concentrates.

DESCRIPTION OF THE PREFERRED EMBODIMENTS

Figure 1:
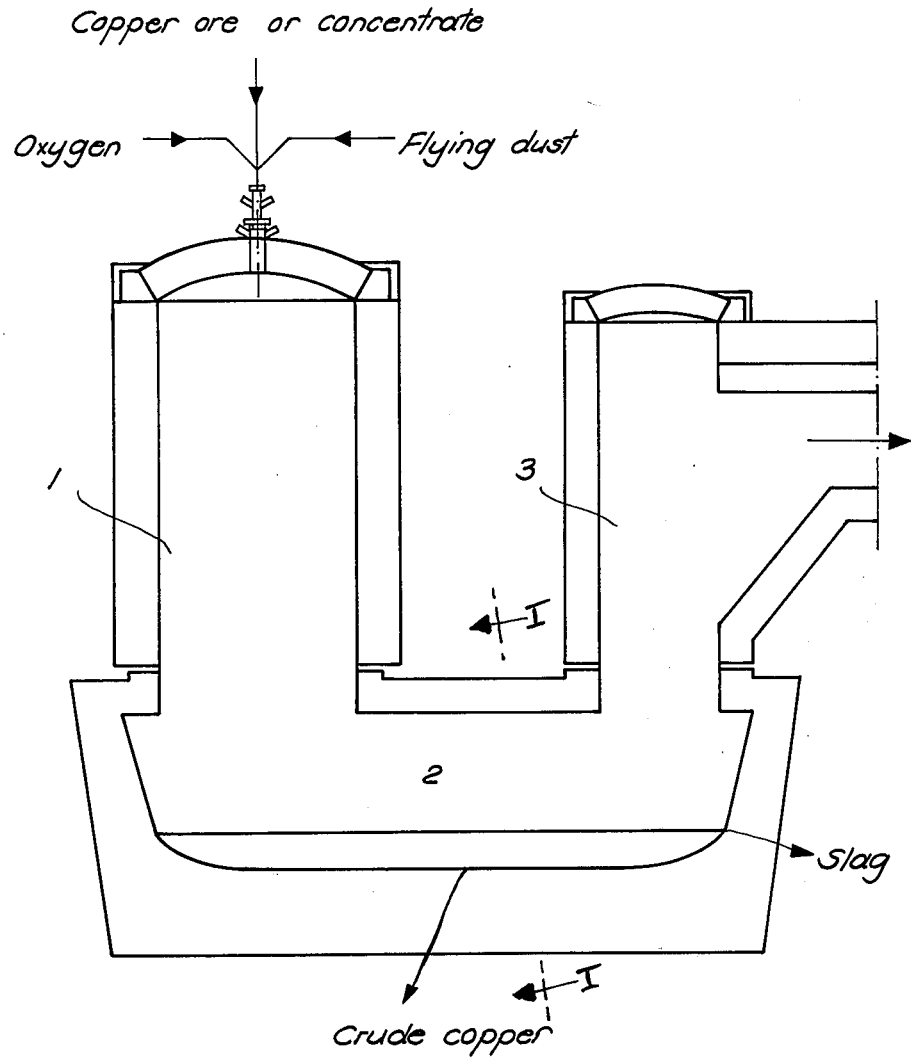
FIG. 1 depicts a section of a side view of a flash smelting furnace, known per se, meant for carrying out the process according to the invention.

A pilot flash smelting furnace (FIG. 1) with a capacity of 0.5–3 t/h was used in the experiments. The diagram of the reaction shaft 1 was approx. 1.5 m and its height 3.5 m. Trials were performed with several different concentrates, operating to produce highly different degrees of oxidation. The temperature of the reaction shaft was 1300–1500° C and the outlet temperatures of slag and metal within the ranges 1200–1450° C and 1150°–1300°C, respectively. The oxygen concentration of the process air used was within 21–65% oxygen. Depending on the concentrate used and the efficiency of the cooling of the reaction shaft, it is possible to raise the oxgyen concentration up to 95% oxygen. Likewise, the former temperatures can be 100°–300° C higher. One example of a trial performed with a concentrate of the chalcocite-digenite type is described below. In these trials the flying dust (5–20% of the feed) emerging from the rising shaft 3 along with the gases was collected after the furnace in a vessel and an electric filter and returned to the cycle in its entirety. Naturally, and especially when the volatile impurity contents in the flying dust or in some part of it rise considerably high, it is possible to remove the dust from the cycle. By keeping the flying dust in the cycle, the products emerging from the furnace are thus metal, slag, and an almost dust-free, $SO_2$-bearing gas. In this case the impurities are forced to divide between the metal and the slag. It must be taken into consideration, however, that depending on the temperature of the electric filter, part of the volatile components can also be removed in a gaseous form. The slags were calcium silicate based, and slag-forming componets were added to them when necessary.

Figure 2:
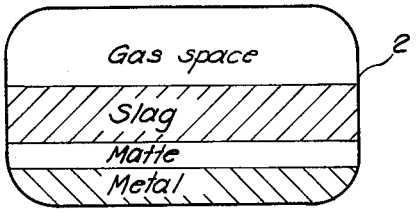
FIG. 2 is a schematic cross section of FIG. 1 along line I—I, when the furnace is operated in the conventional manner.
Figure 3:
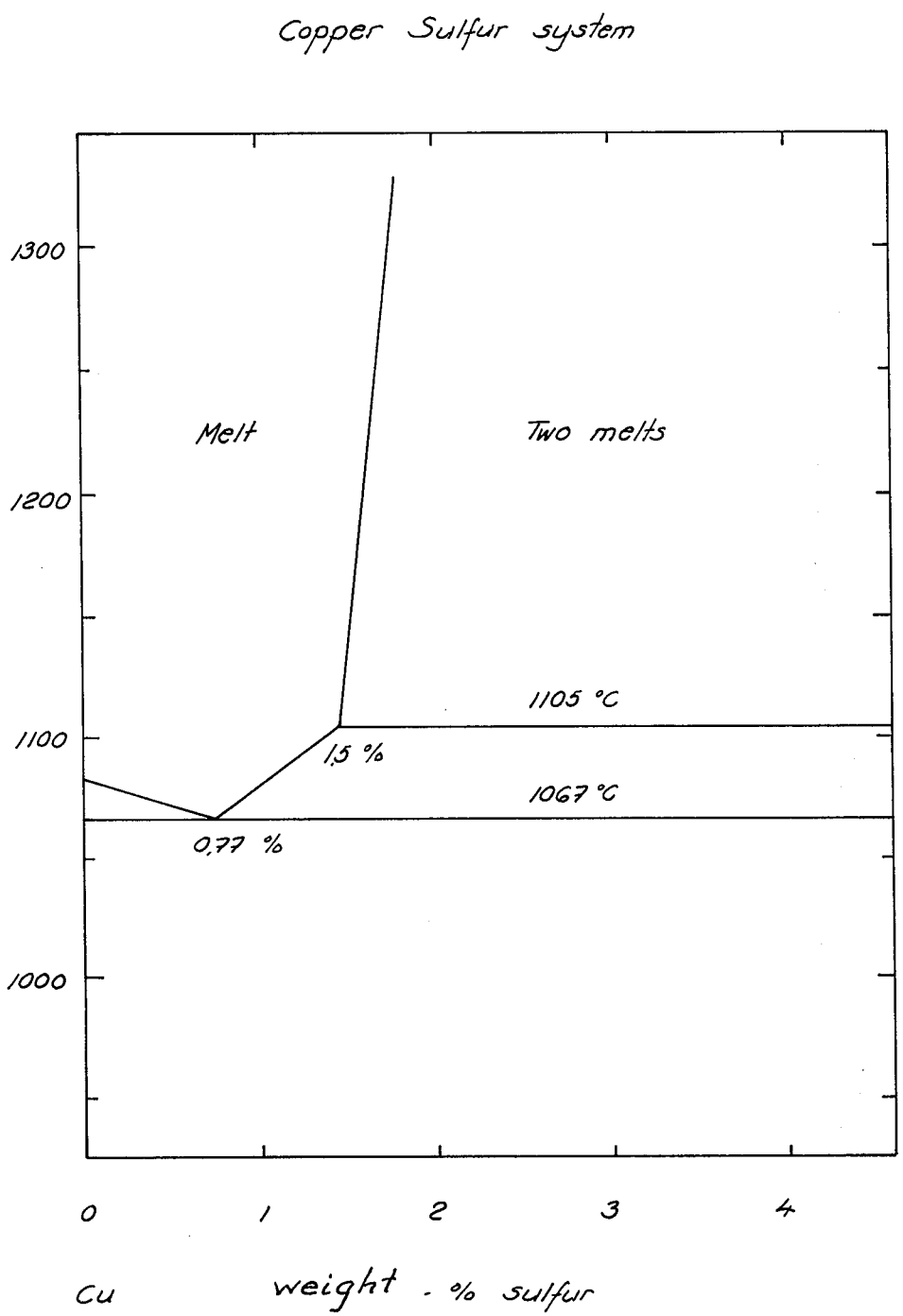
FIG. 3 depicts the equilibrium diagram of a copper-sulfur system obtained under the conditions according to FIG. 2.
Figure 4:
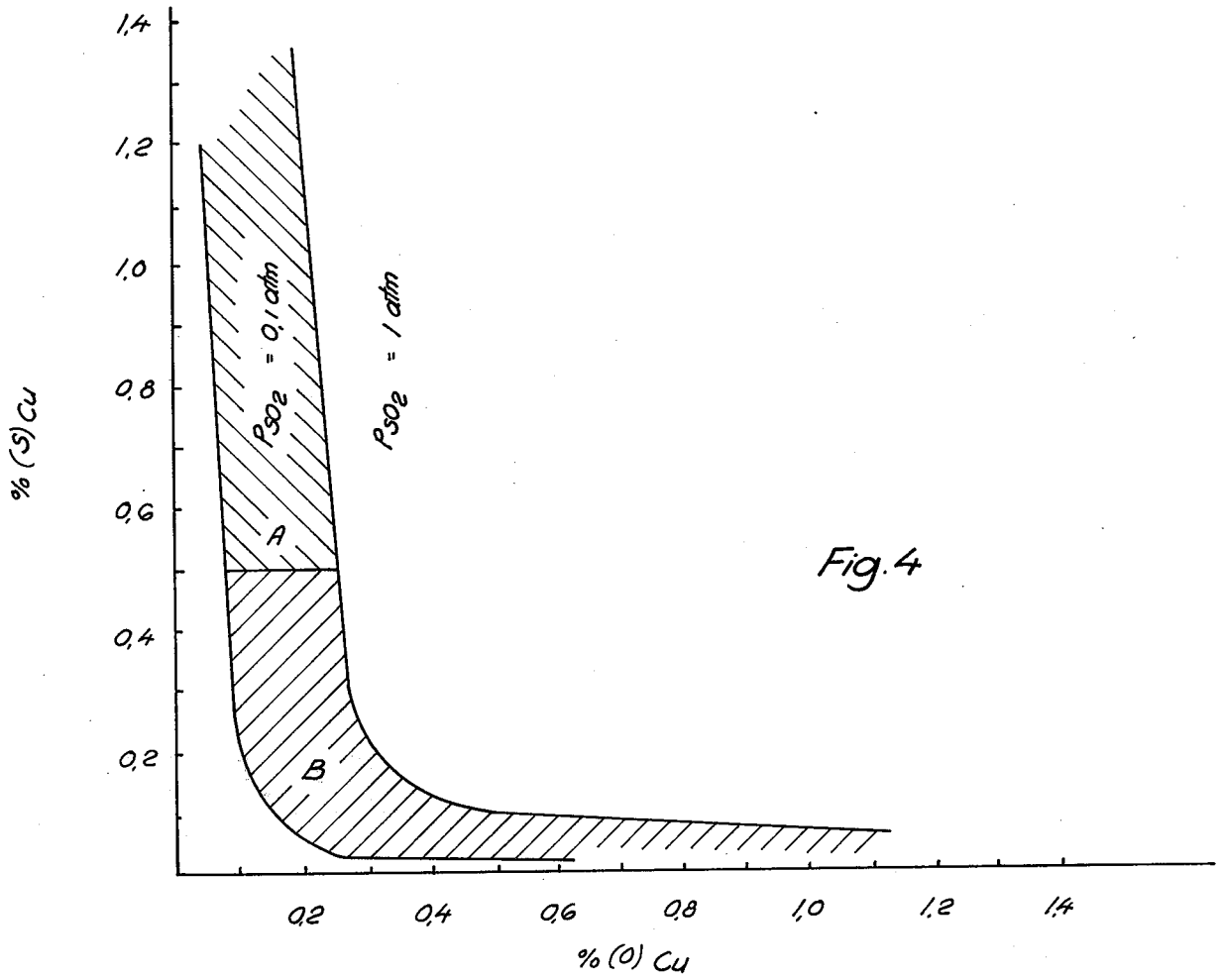
FIG. 4 illustrates the proportions of sulfur and oxygen in raw copper under different partial pressures of sulfur dioxide.

The furnace was first operated with such an oxygen/-feed mixture ratio (degree of oxidation) that metallic raw copper was produced in an equilibrium with high-grade copper matte. In this case there were three molten layers in the lower furnace 2: slag, matte (~white metal) and raw copper. Only slag and raw copper were removed from the furnace. The copper content of the slag has been found to be at the minimum in such a case. A diagram of the principle of the process conditions like the above is depicted in FIG. 2. The copper content of the slag is usually 5–8%, depending on the degree of oxidation and the effect of the other slag components on the activity coefficient of $Cu_2O$. The iron content of the matte can vary within 0–3% $Fe_{matte}$, depending on the iron content of the concentrate and the delay periods. The sulfur content of the raw metal is within 0.5–1.5% $S_{metal}$, since the system is operated close to the equilibrium Cu-$Cu_2S$ (FIG. 3). The oxygen content is usually <0.1% since in this case the operation takes place within the range A, when observing the situation on the basis of FIG. 4.

The balance (Table 1) was calculated from an operation like the above. The operation period was 2.5 days, 78 metric tons of concentrate were treated; the balance has been calculated per one metric ton of concentrate.

tained sulfur 2–4%. This means that in the lower furnace 2 reactions between sulfides and oxides still occur to a considerable degree, part of the raw copper is produced through these reactions, and owing to them the copper content of the slag settles at a relatively low level.

Figure 5:
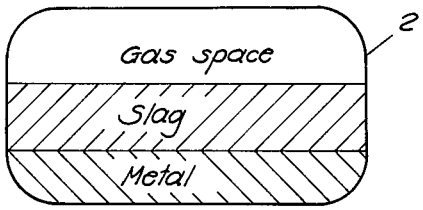
FIG. 5 depicts a schematic cross section along line I—I in FIG. 1, when the furnace is operated according to the present invention.
Figure 6:
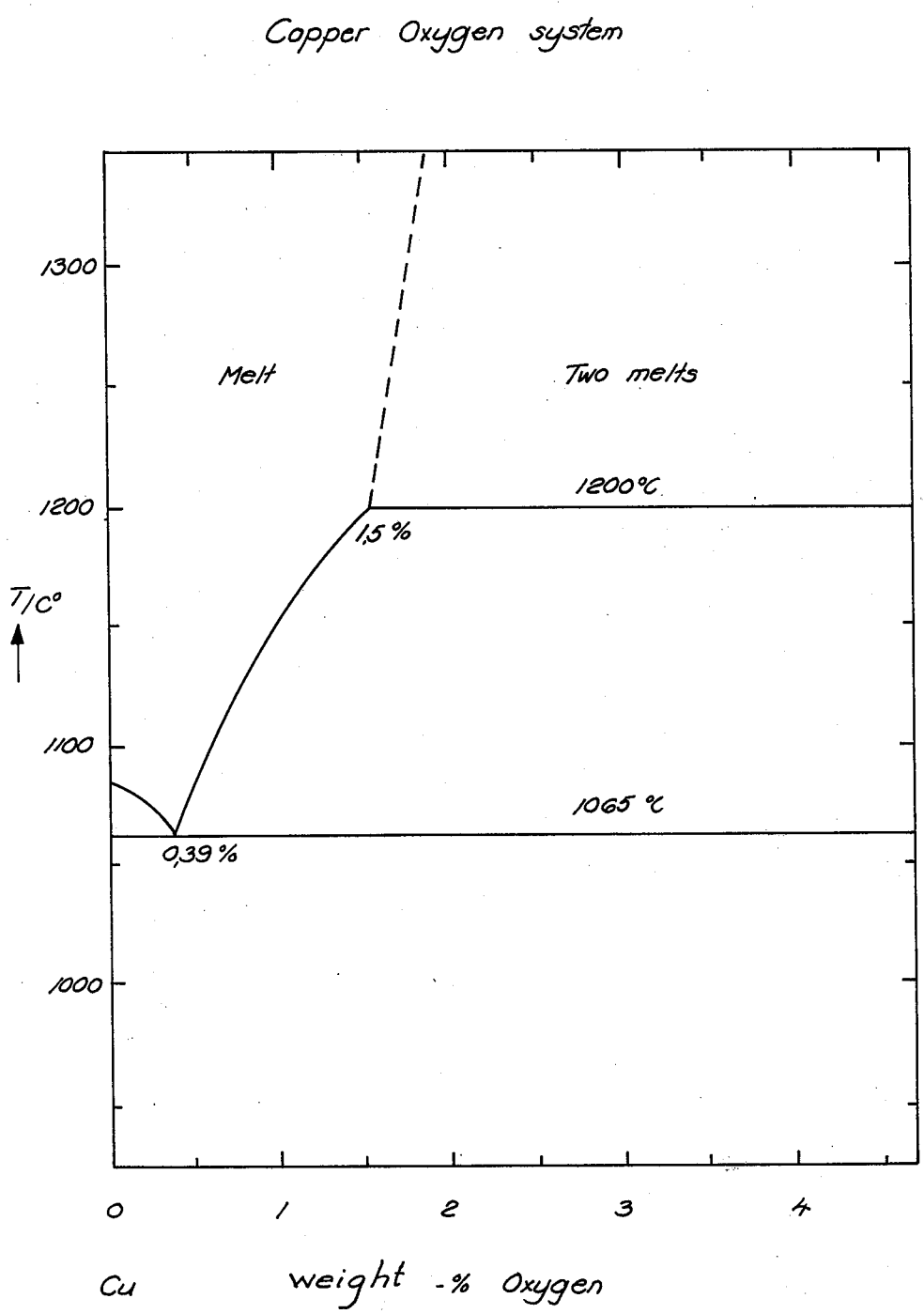
FIG. 6 depicts an equilibrium diagram of the copper oxygen system under the conditions of FIG. 5, in which case the temperature is indicated as a function of the oxygen content.

When the operation conditions in the furnace are changed so that the oxygen/feed ratio rises, raw copper is caused to produce in a dynamic equilibrium with slag without a matte layer between the two (FIG. 5). Thereby the copper content of the slag usually increases to 8–15% and the sulfur content of raw copper is <0.5% and its oxygen content increases, being 0.2–1.5% depending on the temperature and the sulfur content. The oxygen content of the metal begins to follow the values indicating the Cu—$Cu_2$—0 system (FIG. 6), the sulfur content and the pressure of total sulfur dioxide affecting it in the manner indicated in FIG. 4, in which case a transfer takes place to range B in the said figure.

Table 2 shows the balance, per one metric ton of concentrate, of a more oxidizing trial run operated without a matte layer, covering approx. two days. The quantity of concentrate treated was 67 metric tons.

Table 1

| | Quantity | | Cu | | S | | Fe | | O | | Pb |
|---|---|---|---|---|---|---|---|---|---|---|---|
| | kg | % | kg | % | kg | % | kg | % | kg | % | kg |
| Concentrate | 1000 | 48.6 | 486 | 16.3 | 141 | 3.5 | 35 | — | — | 2.2 | 22 |
| Slag | 482.0 | 6.9 | 33.3 | 0.3 | 1.4 | 7.1 | 34.4 | — | — | 3.2 | 15.5 |
| Matte | — | 80.2 | — | 16.9 | — | 1.1 | — | — | — | 0.8 | — |
| Raw copper | 466.7 | 97 | 452.7 | 1.4 | 6.5 | 0.13 | 0.6 | 0.1 | 0.5 | 1.4 | 6.5 |
| Gas | — | — | — | — | 133.1 | — | — | — | — | — | — |

| | As | | Sb | | Bi | |
|---|---|---|---|---|---|---|
| | % | kg | % | kg | % | kg |
| Concentrate | 0.35 | 3.5 | 0.22 | 2.2 | 0.04 | 0.4 |
| Slag | 0.4 | 1.9 | 0.3 | 1.5 | 0.02 | 0.1 |
| Matte | 0.3 | — | 0.1 | — | 0.01 | — |
| Raw copper | 0.2 | 1.1 | 0.1 | 0.5 | 0.06 | 0.3 |
| Gas | — | 0.5 | — | 0.2 | — | — |

As can be seen from the matte and metal analyses, the raw copper has separated in an equilibrium with rich copper matte. Thereby a quantity of sulfur, almost that required by the equilibrium (1.4% S; in equilibrium 1.6% S) has been left in the raw copper. It can be seen from the metal analyses that even after a normal anode furnace treatment it is not suitable for electrolysis since it produces too high impurity contents in cathode copper. The behavior of impurities is illustrated most clearly concerning lead; approx. 0.3% Pb in the anode is regarded as a general requirement. Thus, in an operation of the above type, using the same distribution coefficients, the concentrate should not contain more lead than approx. 0.5%.

When studying in more detail the phenomena and reaction mechanisms in the reaction shaft of a flash smelting furnace, it was noted that the samples taken from the lower part of the reaction shaft 1 still con- Table 2

| | Quantity | | Cu | | S | | Fe | | O | | Pb |
|---|---|---|---|---|---|---|---|---|---|---|---|
| | kg | % | kg | % | kg | % | kg | % | kg | % | kg |
| Concentrate | 1000 | 47.3 | 473 | 16.1 | 161 | 3.5 | 35 | — | — | 2.9 | 29 |
| Slag | 507 | 12 | 60.8 | 0.09 | 0.5 | 6.8 | 34.7 | — | — | 6.8 | 28.4 |
| Raw copper | 418.5 | 98.5 | 412.2 | 0.2 | 0.8 | 0.07 | 0.4 | 0.8 | 3.3 | 0.15 | 0.6 |
| Gas | — | — | — | — | 159.7 | — | — | — | — | — | — |

| | As | | Sb | | Bi | |
|---|---|---|---|---|---|---|
| | % | kg | % | kg | % | kg |
| Concentrate | 0.4 | 4 | 0.25 | 2.5 | 0.04 | 0.4 |
| Slag | 0.6 | 3.0 | 0.4 | 2.1 | 0.07 | 0.38 |
| Raw copper | 0.05 | 0.2 | 0.03 | 0.1 | 0.005 | 0.02 |
| Gas | — | 0.8 | — | 0.3 | — | — |

Figure 7:
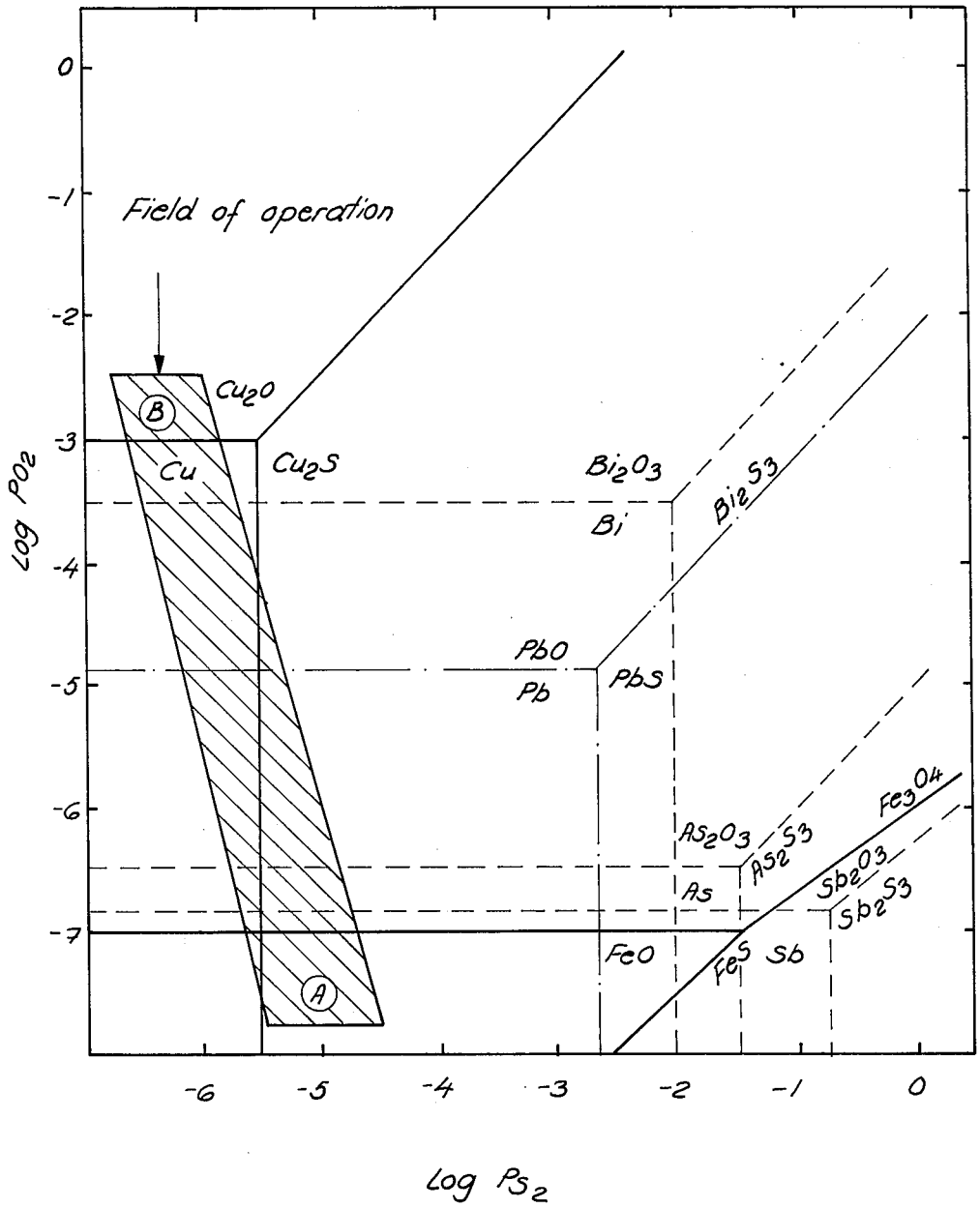
FIG. 7 depicts the equilibriums prevailing in the system (Cu, Fe, Pb, As, Bi, Sb), —O—S, calculated from the specific activities.

When the furnace is operated in this manner, the samples taken from the lower part of the rection shaft have a sulfur content of <1%. This means that nearly all of the sulfur has been burned in the reaction shaft and that the role of the lower furnace reactions is not significant in this case. Raw copper is also produced already in the reaction shaft, and not through oxide-sulfide reactions in the lower furnace. The conditions in the furnace are clearly more oxidizing than in the example first given, which is also illustrated by the higher values of the copper content of the slag. When observing the distribution of the impurities, it can be noted that in these conditions most of them can be slagged since there is no other noteworthy removal from the process for volatile components. The thermodynamic background of the oxidation and the secondary components of the concentrate are illustrated in FIG. 7, which shows the equilibriums prevailing in the system (Cu, Fe, Pb, As, Bi, Sb)—0—S, calculated according to the specific activities. Conditions for the production of metallic copper prevail within the ruled range in the figure. When conditions in which there is a matte layer between the raw copper and the slag prevail in the furnace, the operation takes place closer to range A indicated in the figure. When the degree of oxidation rises, range B is approached, and at the same time a transfer takes place to the stability ranges of the oxides of the impurities, a factor which explains part of their slagging behavior. In regard to each component there is naturally a question of their activity coefficients which in the end determine their distribution between raw copper and slag. The above discussion gives, however, a thermodynamic basis for the behavior of the impurities in the process.

It is obvious on the basis of the results given in Table 2 that the obtained raw copper, after a normal anode furnace treatment, is a suitable raw material for producing high-grade cathodes by electrolysis. As to lead, which was the actual principal impurity in these trials, it can be noted that it can amount to even 6% in the concentrate without its content in the raw copper surpassing 1.3%.

Other impurities can also be present in copper concentrate, such as Zn, Ni, and Co. When the degree of oxidation is raised, their complete slagging is ensured even better than before.

In terms of the entire process it is clear that the slag of the flash smelting furnace must be purified from its valuable metal content. Naturally, the profitability of the process is better the smaller the slag quantities are.

What is claimed is:

1. A process for producing clean raw copper continuously in one stage from at least one raw material low in iron selected from the group consisting of sulfides, copper concentrates and ores containing as impurities at least one element selected from the group consisting of lead, antimony, bismuth and arsenic comprising the steps of:

feeding the raw material into an upper part of a reaction zone, while feeding air or oxygen enriched air into said upper part of said reaction zone for producing a suspension of said raw material in said reaction zone, and controlling the amount of oxygen fed into said reaction zone for controlled oxidation of said raw material to produce a melt containing essentially only raw copper and slag below said reaction zone, and so that said raw copper in equilibrium with the slag contains less than 0.5% by weight of sulfur and 0.2–1.5% by weight of oxygen, feeding said suspension downwards at a temperature of 1300°–1700° C, through said reaction zone, causing said suspension to impinge against the melt below said reaction zone, guiding aside any gases and flying dusts associated with said suspension, and separating and removing said slag at a temperature of 1250°–1450° C and said raw copper at a temperature of 1150°–1350° C.

* * * * *